United States Patent [19]

Rawicz et al.

[11] 4,004,729

[45] Jan. 25, 1977

[54] AUTOMATED FIRE CONTROL APPARATUS

[75] Inventors: Harris C. Rawicz, Bridgewater; William J. Bigley, Scotch Plains, both of N.J.; Gene L. Cangiani, Bronx, N.Y.; Rene C. Yohannan, Sterling, N.J.

[73] Assignee: Lockheed Electronics Co., Inc., Plainfield, N.J.

[22] Filed: Nov. 7, 1975

[21] Appl. No.: 629,976

[52] U.S. Cl. ..... 235/61.5 S; 33/238; 235/61.5 E

[51] Int. Cl.[2] ..... G06F 15/58; F41G 3/08

[58] Field of Search ..... 235/61.5 E, 61.5 DF, 235/61.5 S; 33/237, 238, 239; 89/41 E, 41 AA

[56] References Cited

UNITED STATES PATENTS

| | | | |
|---|---|---|---|
| 2,715,776 | 8/1955 | Knowles et al. | 235/61.5 S X |
| 3,575,085 | 4/1971 | McAdam, Jr. | 89/41 E X |
| 3,685,159 | 8/1972 | Erhard | 33/238 |
| 3,798,420 | 3/1974 | Kaaz | 235/61.5 S |
| 3,845,276 | 10/1974 | Kendy et al. | 235/61.5 S |

*Primary Examiner*—Jerry Smith

[57] ABSTRACT

Improved automated fire control apparatus includes servomotor positioned weapon(s), range-determining radar, optical sight and controller, and a data processor. Multiple, improved feedback network organizations are provided to control the optical sighting path vis-a-vis gun mount for automated lead angle implementation under overall gunner supervision. Thus, for example, optical line of sight deflection is controlled, inter alia, by radar antenna positioning, target flight projection computations as well as manual gunner signal entry.

22 Claims, 4 Drawing Figures

AUTOMATED FIRE CONTROL APPARATUS

DISCLOSURE OF THE INVENTION

This invention relates to electronic weapons system control and, more specifically, to an improved, automated fire control system, as for anti-flying vehicle gunnery.

The technology of controlling the fire of a gun vis-a-vis a flying object such as an aircraft, missile, or the like, has obviously progressed many fold in sophistication since the days of "Kentucky windage" when a gunner (as at a shipboard anti-aircraft station) would physically aim a weapon system, doing his best to suitably lead the target while firing at his postulated target-projectile intersecting point. Thus, it is the present day practice to provide digital computer control for firing a major gunnery system. The computer determines a preferred shell trajectory based upon inputs received from a self-tracking ranging radar, gun and ship status reporting gryro sensors, and the like.

A typical gun control environment generally applicable to both state of the art gunnery of the principles of the present invention is shown in FIG. 2. There is included one or more guns 100 rotationally secured to a gun supporting rotatable mount 102, e.g., on an anti-flying vehicle station. A self-tracking antenna 106 is employed to track a target 112 shown at a present position 112*a*. The antenna is energized by a transmitter 108, and supplies its recovered signals to a conventional self-tracking radar receiver 110 which supplies range information and the like to a computer 68. The antenna 106 is itself positioned to track the aircraft in any manner well known to those skilled in the art, as by the data processor 68.

A gunner-controller associated with the weapons 100 looks through an optical sight 104 along an optical line-of-sight 104*a* and attempts to center the aircraft 112*a* in the center (herein "cross hairs") of the optical sight. He does this by issuing electrical commands at a controller 105 (e.g., multiple axis by "joy stick"). By processes below described, such electrical signals emanating from the controller 105 cause (a) a lead angle 114 to develop between the optical axis 104*a* of a sight 104 and the actual pointing azimuth of the guns 100, and (b) a rotation of the gun 100 mount vis-a-vis a fixed reference (e.g., ships axis) to maintain the target in the optical sight 104 cross hair. After the proper lead angle (obviously range dependent as reported by the associated radar) has been developed and the target is in the proper optical sight position, the weapon system may be fired.

The gunner's principal function then is to issue electrical signals from his controller 105 which maintains the aircraft in its proper, centered position in the optical sight. By simply doing this, the remaining functions required for firing will automatically be effected by computer intervention and through the action of the various other system sensing and driving elements.

The above general description has focused upon determining the proper angular, or azimuth orientation of the guns. Similar operations occur as well to develop the requisite gun elevation.

A prior, state of the art, gun control system is schematically shown in FIG. 1, and employs a gun mount servo motor 22 which responds to the electrical signals issued by the gunner actuated controller 105 (FIG. 2), by rotating at a rate, and in a direction, specified by the controller output. As the servo motor 22 causes an angular (azimuth) rotation of the controlled firing weapon (s) 100, the angular rate of rotation of the gun case and mount is reported by a rate sensor 27 (e.g., a rate servo) to the digital computer 68. The computer 68 responds to the radar reported target range and the gunner effected mount 102 swivel rate by effecting a lead angle computation 30 to develop the proper azimuth lead angle $\lambda_\theta$ . That lead angle is implemented by a servo motor 24 which positions the optical axis 104*a* of the optical sight 104 vis-a-vis a reference common with the gun (the gun case) — typically by simply rotating a line-of-sight 104*a* determining mirror in the sight 104. Thus, when the operator causes the controller 105 to issue an output rate command, servo 22 rotates the entire gun platform 102 and all elements mounted thereon including the optical sight case 104 and the radar antenna 106, to a position where the weapons 100 are disposed toward the "future" or target-projectile intersection point 112*b*. The servo motor 24 then causes a further rotation, relative to the gun case or mount platform rotation to change the optical axis 104*a* of sight 104. A radar antenna servo motor 25 is also connected to the lead angle $\lambda_\theta$ output of the computer 68 such that the antenna is maintained coaligned with the optical axis of sight 104 which, presumably, is directed toward the present position of the target 112*a*. As used herein, the term "servo motor" designates any actuator causing a mechanical motion in response to an electrical command signal.

In the case of a target aircraft 112 flying from left to right as in the FIG. 2 case, it will be appreciated that the azimuth of firing line of the guns 100, oriented toward the future target position 112*b*, will lead (clockwise) the instantaneous optical line of sight for sight 104 and the antenna 106 which are directed at the present target position 112*a*.

For an assumed theoretical case of an aircraft flying at constant speed in a circle of constant speed and elevation about the gun mount, the above assumed dispositions of the antenna 106, optical axis 104*a* and guns 100 would remain the same relative to one another, the entire platform or mount 102 simply rotating at a constant speed. For more typical flight trajectories, the lead angle is determined by interaction of the gunner controller 105 and the computer 68, and is constantly updated seeking to follow the actual aircraft trajectory.

The particular manner in which the computer 68 determines the lead angle $\lambda_\theta$ is well known to those skilled in the art and, in fact, actually employed in systems of the FIG. 1 type — such as in the M86 shipboard fire control system. In brief, the computer 68 receives as inputs, inter alia, the output of rate sensor 27 which signals the instantaneous rotational speed of the mount, and the range to target at an input terminal 69 as developed in any manner well known to those skilled in the art by the radar receiver 110. The computer 68 has stored therein software for responding to these inputs for determining the lead angle $\lambda_\theta$ . Thus, for example, the lead angle computation programming 30 for effecting this may comprise an iterative loop comprising target flight model 32 and projectile ballistic trajectory model 26 for determining time of flight ($T_{OF}$) to target-projectile intersection. The iterative processing continues until the position of a fired projectile in space at a time $T_{OF}$ after firing coincides within desired accuracy limits with the position in space of an aircraft at the range specified by the radar.

The above-described apparatus positions the weapon in one coordinate (azimuth). It will be appreciated that like circuitry is employed as well to fix gun elevation.

However, the prior art FIG. 1 arrangement is not entirely satisfactory for the rapid, ever increasing speeds which characterize present day hostile air vehicles. Thus, for example, it is sometimes difficult in the case of a rapidly moving target for the controller to lock his optical axis 104*a* onto the target as the target is first encountered. That is, the gunner will first actuate his controller 105 to rapidly rotate the mount 102 to center the target along his optical line of sight. This mount 102 rotation will be signalled by the sensor 27 to the computer 68 which will interpret it as the angular fly by rate of the aircraft. Accordingly, the computer 24 will generate a lead angle which will rapidly change the line of sight determining mirror via the servo 24 (in the case of FIG. 2, rapidly shifting the line of sight axis 104*a* counter clockwise). The net effect of these rotations will make it difficult for the gunner to in fact lock the aircraft in his sight cross hairs and rotate the mount at the necessary rate to maintain the aircraft locked, both being required before accurate firing may commence. Thus, these prior state of the art systems have been experiencing difficulty in effecting the kill percentage desired for the weapon system where confronted with rapidly moving targets.

It is therefore an object of the present invention to provide an improved automated fire controller system.

More specifically, an object of the present invention is the provision of a fire controller system which will permit target acquisition and lock on in a relatively short time interval, permitting a relatively large period for target kill as the target flies within range of the firing weapon.

The above and other objects and features of the present invention are realized in an illustrative automated fire control system which employs a central processing unit a tracking radar, an optical target sight with movable sighting axis, and a controlled weapon. A gunner actuated controller operates in a first feedback loop to maintain the optical axis characterizing the gunner sight device, and the associated tracking radar antenna, aligned with the present position of the target. The computer apparatus generates a lead angle signal which operates in conjunction with the optical line of sight deflecting servo loop for controlling the rate of rotation of the gun mount.

In accordance with varying aspects of the present invention, several signals are selectively interposed between the output of the gunner controller and the optical line of sight shifting actuator to control the optical axis and radar antenna orientation. These signals represent future target rate projections from the computer, and radar (and optical) misalignment signals developed by the radar receiver. The net effect of such signals, assuming sufficient system accuracies, causes the system to automatically track a target once lock-on has been achieved, subject to gunner correction via his controller should any inaccuracies appear, i.e., should the target drift out of his optical sight centering.

The above and other features and advantages of the present invention will become more clear from a detailed description of specific automated gun control apparatus, presented hereinbelow in conjunction with the accompanying drawing, in which.

Figure 1:
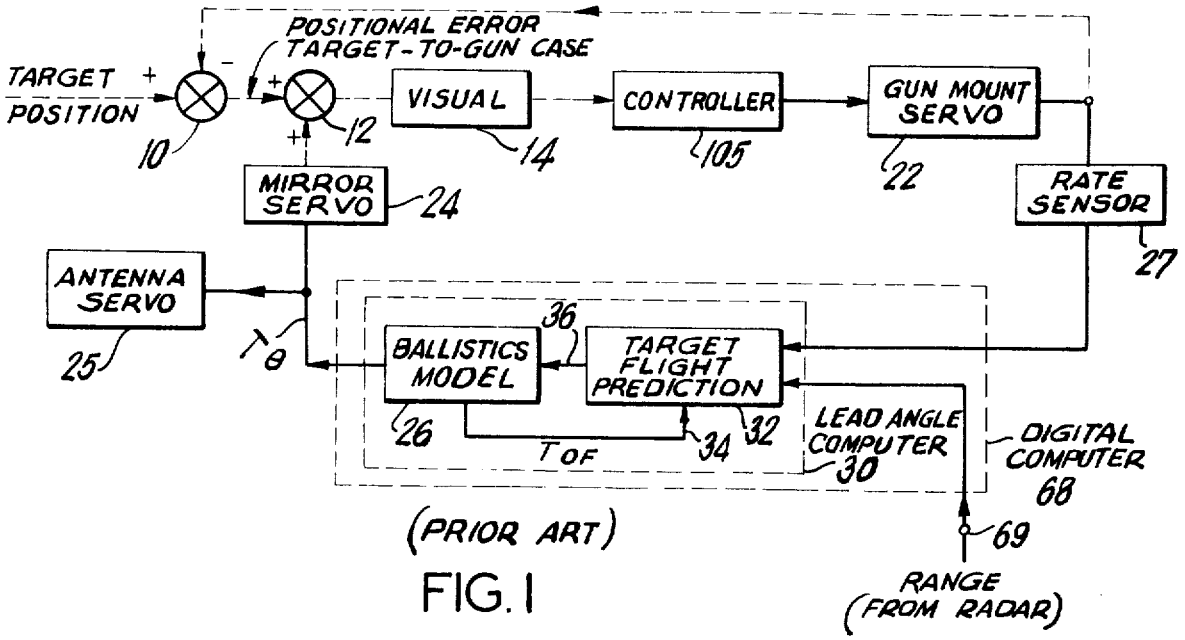
(PRIOR ART) FIG. 1
FIG. 1 is a description of prior art automatic gun control apparatus discussed above.
Figure 2:
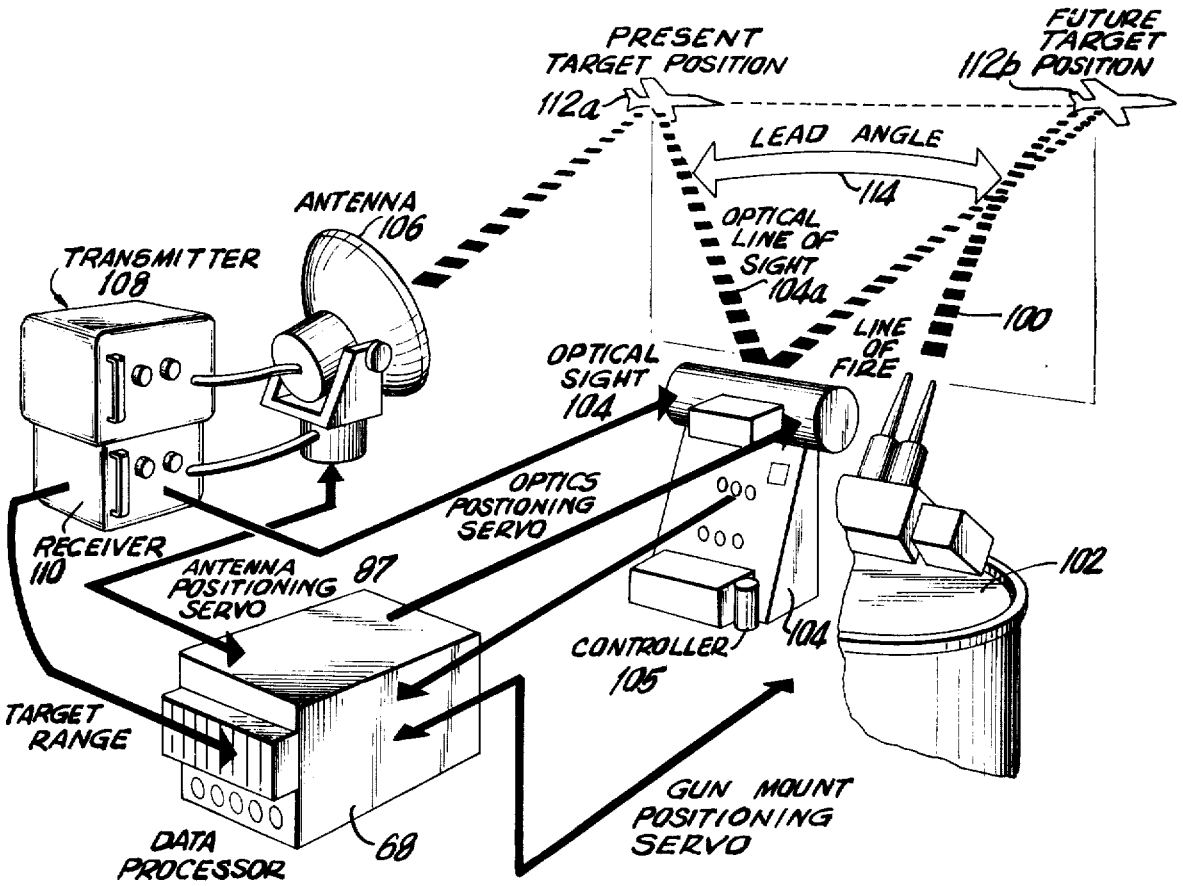
FIG. 2 is a generalized depiction of an automated gun control environment.
Figure 3:
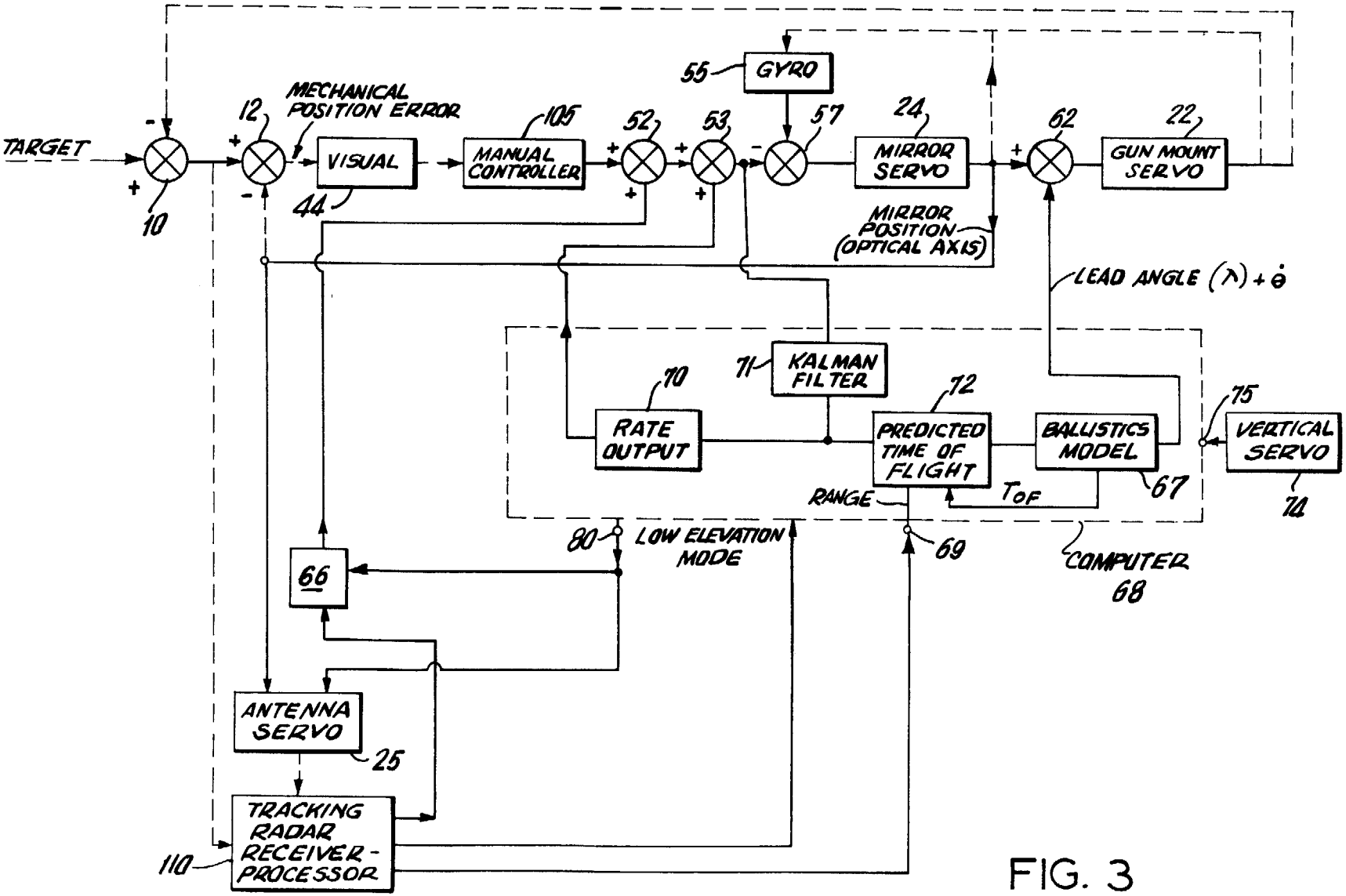
FIG. 3 is a schematic diagram of automated gun control apparatus embodying the principles of the present invention.

Referring now to FIG. 3 there is shown an automated gun control system in accordance with the principles of the present invention. The arrangement is employed within the general context of the automated gunnery apparatus of FIG. 2 i.e., employing a self-tracking radar 106, 108, 110, optical sight 104, firable weapon (s) 100 and the like to destroy a flying vehicle 112. The arrangement of FIG. 3 employs as device actuators a mirror servo motor 24 for changing the optical line of sight 104a of the optical sight 104 (as by mirror rotation); a gun mount servo motor 22 for controlling the relative positioning of a movable gun case mount 102 relative to a fixed frame of reference (e.g., ships axes); and an antenna servo 25 for positioning the antenna 106. As before, the following discussion focuses on one positioning coordinate (azimuth [$\theta$]), it being understood that the other weapon positioning coordinate (elevation [$\theta$]) employs similar apparatus and circuitry. Thus, for example, the gun mount servo motor 22 controls the lateral, clockwise-counter clockwise positioning of the gun mount 22 while a similar servo motor is employed as well to raise or lower the gun barrel independent of the azimuth disposition.

The hardware included in the FIG. 3 arrangement is shown in solid line while that part of the system of conceptual importance is indicated by dashed lines. Thus, for example, FIG. 3 shows a summing node 10 which computes the angular difference, or error, between the target and the gun case. In fact, such a difference or error is visually sensed by the gunner although no electronic apparatus is employed to actually generate an electrical signal or the like to reflect this parameter.

The particular structure and functioning of the FIG. 3 arrangement will now be considered. As an initial matter, upon viewing an enemy aircraft 112, a gunner looking along the optical axis 104*a* of his optical sight 104 activates his controller 105 in a direction which will position the aircraft at the center, or cross hair position, of the sight. The electrical output of the controller 105 passes through summing nodes 52, 53 and 57 described below, the output of summing node 57 actuating the mirror servo motor 24. By such a process, the servo motor 24 changes the optical axis 104*a* (i.e., rotates a deflecting mirror) for proper positioning (target sight-centering).

As shown in FIG. 3, the positional output of the servo motor 24 (determining the optical axis 104*a*) is in essence controlled by a feedback loop which includes the intervention of the human gunner. That is, the output of a conceptual summing node 10 (the mechanical azimuth position of the target with respect to the gun case) is supplied to a second algebraic summing node 12 having as an output the difference between the output of node 10 (the desired optical axis position for the 10 obtaining gun-mount-target spacial relationship), and the output mirror servo motor 24 (the actual axis positioning). Any difference between the two inputs to conceptual summing node 10 is observed physically by the gunner who sees the target other than centered between his cross hairs — and who therefore operates his controller 105 to actuate the servo motor in a direction to overcome that difference.

Apparatus 55 is employed to signal the summing node 57 with the output status (rotational rate) for the gun mount (servo motor 22, mirror servo motor 24 — and platform motion). The element 55 may thus comprise a simple inertial mirror rate gyro, is applied to the summing node 57 in a sense opposite to the output of the summing node 53. The purpose of the rate gyro 55 will be understood from a steady state analysis for the case of an aircraft target flying in a circle about the gun position. For such a steady state condition, the optical axis 104*a* is locked upon the target, and is rotated at a certain constant angular rate. Similarly, the gun mount servo 22 is locked onto the "future" target position; and is rotating at a like rate, but with the appropriate lead angle dependent upon target range and speed. Since for the assumed case the optical sight is itself fixed for rotation with the gun case, no further mirror servo motor rotation is required for this steady state case. Thus, the gyro 55 is employed to cancel out signals supplied to the node 57 by the node 53 from a target rate predicting output 70 of the computer 68 which would otherwise cause mirror rotation. Similarly, from such a steady state analysis, it will be appreciated that the required mount 102 rotational rate $\dot{\theta}$ is supplied to servo motor 22 via the computer 68 (together with the lead angle signal).

It is, of course, desired that the self-tracking radar antenna 106 be aligned in the azimuth, $\theta$ direction being considered with the optical axis 104*a* so that the aircraft target is centered in the radar search beam. To this end, the antenna positioning servo motor 25 is simply coupled to the positional output of the mirror servo motor 24 and is slaved thereto. The antenna servo motor 25 includes an additional, alternative elevation signal for operation in a low elevation mode for purposes below discussed.

The computer 68 effects several system functions. In particular, the computer 68 employs the above-considered target flight — projectile ballistics model software routines 72, 67 to determine the appropriate firing lead angle 114. The computer 68 also derives from the target flight part predicting routine 72 the projected target rates $\dot{\theta}$ and $\dot{\phi}$. As shown in FIG. 3, the rate output $\dot{\theta}$ (for azimuth processing) is supplied to the summing node 53, while the lead angle ($\lambda_\theta$) and $\dot{\theta}$ signals are supplied to the summing junction 62.

Figure 4:
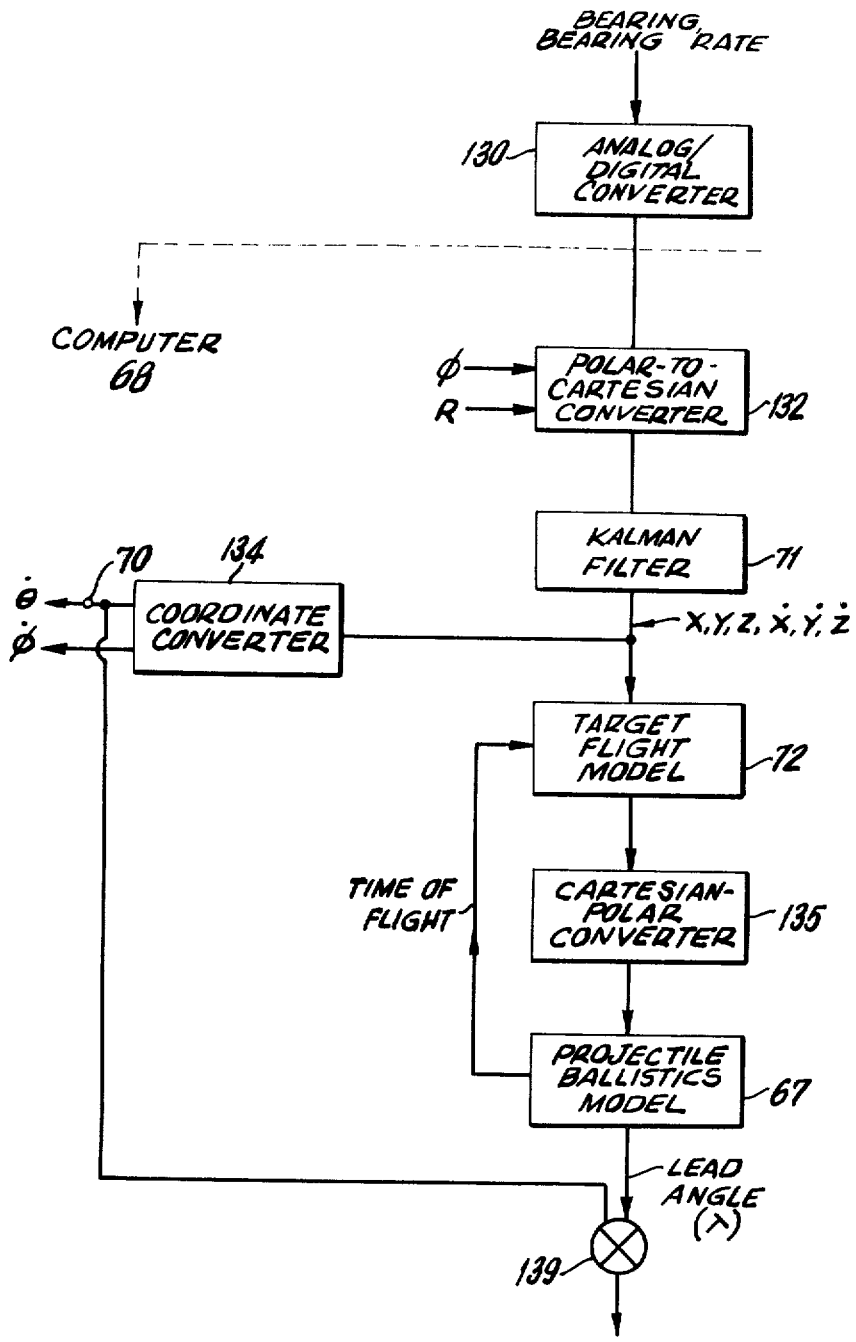
FIG. 4 is a flow chart depicting data processing for the FIG. 3 arrangement.

The particular data processing for effecting the above computer 68 functioning is set forth in FIG. 4. The bearing rate ($\dot{\phi}$) input from the output of summing node 53 is converted to digital form by an analog-to-digital converter 130 and supplied as a digital input to the computer 68. If a bearing rate input is used, it is integrated to obtain the $\theta$ quantity. The azimuth bearing ($\theta$) together with the elevation angle ($\phi$) and the range to target (R) from the radar receiver 110 are supplied as inputs to a polar-to-cartesian coordinate conversion program 132. The software 132 converts the polar azimuth ($\theta$), elevation ($\phi$) and a range (R) coordinates into their Cartesian values $\dot{X}$, $\dot{Y}$ and $\dot{Z}$. The equations for converting polar coordinates to Cartesian coordinates forming the algorithm of coding 132 are, of course, well known to those skilled in the art. A Kalman filter 71 is then employed for data smoothing and predicting, and to develop the Cartesian velocity vectors X, Y, and Z (as by measuring coordinate changes over known incremental time intervals).

The Cartesian target velocity components, developed in data processing 71, are converted to polar form in a Cartesian-to-polar coordinate converter 134 (again employing well known relationships) to yield the polar velocities $\dot{\theta}$ and $\dot{\phi}$. The $\dot{\theta}$ velocity is then supplied as an azimuth rate output by the computer 68 and passes as the second input to the summing node 53 (FIG. 3).

The output of the Kalman filter 71 is supplied to flight modeling 72 and projectile ballistics model software 67, and an intermediate Cartesian-to-polar converter 135 for iterative processing to obtain an output signal identifying the appropriate lead angle ($\lambda_\theta$) 114 and lead angle rate of change ($\dot{\lambda}_\theta$) between the gun and line of sight azimuths, which is combined at a summing node 139 with the target bearing rate. The output of summing node 139 is then supplied as an input to the summing node 62 (FIG. 3). Again, the individual software segments illustrated in FIG. 4 are per se well known to those skilled in the art, and require no further explanation. See, for example, a paper entitled "Advance Concepts in Terminal Area Controller Systems," H. McEvoy and H. C. Rawicz, Proceedings, Aeronautical Technology Symposium; Moscow, July 1973, or LEC Report No. 23-2057-8600 entitled "GFCS Mk86 Ballistics Improvement Study," Final Report, May 31, 1973 prepared under Naval Ordinance System Command Contract No. N00017-67-C-2309, the disclosure of such representative documents being incorporated herein by reference.

Returning to the FIG. 3 arrangement, it is observed that the radar receiver 110 supplies an error signal as one input to the summing node 52, which represents any departure of the target from its centered position with respect to the radar antenna orientation. Thus, for example, the composite radar apparatus 106, 108, 110 may comprise a self-tracking radar system which examines radar reflecting, return signal contributions at spaced equal areas symmetrically offset from the central antenna axis. If the antenna is properly centered on the aircraft, such received signal contribution are substantially equal in amplitude. If the two return signal amplitudes are unequal, indicating that a misalignment obtains between the antenna vis-a-vis the target, a signal is generated to indicate the direction and amount of such imbalance. This signal, again, is supplied as one input to the summing node 52.

With the above equipment description in mind, operation of the composite FIG. 3 fire control system will be briefly reviewed. In the manner above described, and ignoring for the moment the outputs of the radar receiver-processor 110 and the computer target rate projection signal supplied to the summing network 53, the gunner seeing a target simply operates his controller 105 to direct the optical line of sight 104*a* to the present target position in the manner above described, i.e., via the servo actuator 24. As the mirror servo motor 24 adjusts the optical line of sight 104*a*, the positional output of the servo motor 24, together with the lead angle and rate output supplied by the computer 68 to the summing node 62 serve as a rate input to the gum mount 102 moving servo motor 22. Thus, as the gunner actuates his controller 105 to maintain his line of sight 104*a* on the target, the radar-supplied range information and the gunner developed rate of azimuth change information generate the lead angle prediction to appropriately position the gun mount relative to the line of sight. Still ignoring for the moment the function of the summing points 52 and 53, the arrangement continues to function in the above described manner with the gunner simply destroying his controller 105 to maintain the present aircraft position in his line of sight cross hair by effecting all needed adjustments of the servo motor 24. Such action will automatically position the gun to the appropriate lead angle, and with the appropriate angular rotation.

As a substantial aid to the gunner, the computer rate output 70 supplies to the summing node 53, and thence via the summing node 57 to the servo motor 24, the computer's prediction for the rate of change of azimuth of the target. If the computer prediction is fully accurate, and assuming accurate system alignment, at steady state, the computer rate prediction will be exactly balanced by the gyro 54 output signaling that the gun mount is rotating at the requisite speed to maintain the necessary lead angle. The line of sight 104*a* is thus maintained on the target 112*a* in the optical sight 104 cross hairs without requiring any controller 105 (or gunner) participation. Thus, assuming such precise system operation, the gun 100 will automatically track the target with no operator intervention. If something less than such precise tracking is being effected, the gunner simply observes the direction and speed of movement of the target out of his cross hair and enters a signal via controller 105 to again bring the target into proper sight registration. In such a mode of functioning, the gunner need correct for only a smaller, more slowly changing error signal than would be required if he was constrained to maintain the target in the cross hair orientation completely under his own auspices. Automated fire control accuracy and efficiency is therefore improved.

Similarly, the input to the summing node 52 from the radar receiving-propellor 110 also serves to aid the gunner by supplying a correction signal to suitably move the servo motor 24 if the radar senses that the target is moving out of its centered posture vis-a-vis the antenna 106 — as in the manner above described. Since the antenna servo motor 25 maintains the antenna 106 co-aligned with the optical line of sight 104*a*, any departure from antenna centering will also signal a like departure with respect to the optical sight 104. Thus, the summing nodes 52 and 53 serve to automatically position the mirror servo 24 (and thereby also the gun mount via the computer 68 and servo motor 22), and therefore greatly simplify the burden of the gunner and, indeed, often permit automatic, hands off gun control once lock has been achieved on the target. The gunner's burden after lock is simply to make mirror corrections to accomodate antenna position-optical line of sight misalignments or aircraft rate prediction deficiencies which may arise, if any.

It is again emphasized that the above discussion, and the FIG. 3 arrangement, principally discuss gun control along one of the two requisite axes. In particular, the discussion has centered about the azimuth, or $\theta$ gun control coordinate. As also discussed, similar structure is employed with respect to the elevation or $\phi$ variable. Thus, for example, a servo operable in the vertical direction deflects the optical line of sight as by moving the deflection mirror in the vertical direction; a servo motor comparable to the servo motor 22 is employed to raise and lower gun elevation; and a servo motor comparable to the servo motor 25 is employed to raise and lower the antenna orientation.

In this latter respect, it is observed, however, that it is sometimes undesirable to lower the antenna elevation below a certain minimal level. Thus, for example, in the case of a shipboard antiaircraft application, it is undesirable to lower the radar antenna to the point where serious water surface reflections interfere with target acquisition and tracking in the case of low flying hostile aircraft.

To this end, the composite FIG. 3 arrangement includes a vertical antenna gyro 74 for signalling to the computer via a terminal 75 the vertical ($\phi$) elevation of the antenna. When the vertical elevation equals the minimum desired orientation, the computer switches antenna control to a "low elevation mode," supplying the vertical antenna servo motor corresponding to the motor 25 with a minimum elevation value. When this low elevation mode status obtains (as signalled by the computer 68 at output node 80), correction circuitry 66 operates to obviate the intentionally caused $\phi$-axis disagreement between the radar antenna axis and the optical line of sight (elevation). The circuitry 66 may simply comprise a controlled switch for disabling the connection between the elements 110 and 52 in the presence of low elevation mode operation signalled by the central processing unit 68 at output node 80.

Thus, the FIG. 3 automated gun control apparatus has been shown by the above to readily lock onto and maintain tracking and shooting alignment with a target, and to require minimal supervision by an operator — (gunner) — thereby simplifying his task and providing a weapons system with improved efficacy.

The above described arrangement is merely illustrative of the principles of the present invention. Numerous modifications and adaptations thereof will be readily apparent to those skilled in the art without departing from the spirit and scope of the present invention. For example, the rate servo inputs discussed hereinabove may be replaced by positional inputs as well known per se by those skilled in the art, making suitable changes in the corresponding sensors and with a resulting correspondingly changed response characteristic. Thus, for example, a position rather than rate gyro 55 may be employed, and the output of gyro 55 treated as a position input along with the signal provided by the controller 105 to the mirror servo motor 24.

Then also, the FIG. 3 arrangement will also typically include structure to automatically overcome the motion of the platform supporting the weapon 100, sight 104, antenna 106 and the like — i.e., ships pitching and rolling. This is readily accomplished by including a further summing node in series with the nodes (or employing one such node for multiple summations), and supplying platform rate (or position) signals as inputs thereto.

What is claimed is:

1. In combination in a fire control system for controlling the firing trajectory of a weapon, an optical sight including optical line of sight axis determining means and means for variably adjusting said optical axis determining means, gunner actuated controller means, said optical axis adjusting means being connected and responsive to the output signal generated by said gunner actuated control means, weapon position varying means, means for signalling the positional status of said weapon positioning means, and means connected to and responsive to the output of said weapon positional status signalling means for controlling said optical axis adjusting means.

2. A combination as in claim 1 further comprising means responsive to the output of said optical axis adjusting means for controlling said weapon position varying means.

3. A combination as in claim 2 further comprising lead angle determining means for supplying a lead angle signal to said means for controlling said weapon position varying means.

4. A combination as in claim 3 further comprising a tracking radar, said tracking radar including receiver means for generating a signal characterizing a target as being on or off the radar antenna axis, said receiver supplying said target-antenna axis relative position signal to said optical axis determining means adjusting means.

5. A combination as in claim 2 further comprising lead angle computing means, said means for controlling said weapon position varying means being connected and responsive to said lead angle computing means.

6. A combination as in claim 1 further comprising tracking radar means.

7. A combination as in claim 6 wherein said tracking radar means includes an antenna, and an antenna positioning servo motor controlled by the output of said optical axis determining means.

8. A combination as in claim 6 wherein said tracking radar means includes an antenna, and wherein said antenna and said sight are mounted for movement with the controlled weapon under control of said weapon position varying means.

9. A combination as in claim 1 further comprising a tracking radar, said tracking radar including receiver means for generating a signal characterizing a target as being on or off the radar antenna axis, said receiver supplying said target-antenna axis relative position signal to said optical axis determining means adjusting means.

10. A combination as in claim 9 further comprising data processing means for generating an output signal predicting target motion rate, said optical axis determining means being connected to said data processing means and responsive to the output of said target rate predicting signal supplied therefrom.

11. A combination as in claim 1 further comprising data processing means for generating an output signal predicting target motion rate, said optical axis determining means being connected to said data processing means and responsive to the output of said target rate predicting signal supplied therefrom.

12. A combination as in claim 1 further comprising radar antenna positioning means responsive to the positioning of said adjustable optical axis.

13. A combination as in claim 1 further comprising radar antenna misalignment signalling means, and means responsive to said antenna misalignment signalling means for controlling said optical axis adjusting means.

14. A combination as in claim 1 further comprising target movement predicting means, and means responsive to said target movement for controlling said optical axis adjusting means.

15. In combination in a fire control system for controlling the firing trajectory of a weapon, an optical sight including optical axis determining means and means for variably adjusting said optical axis determining means, radar means, servo actuator means responsive to the state of said optical axis positioning means for normally directing said radar antenna along said optical axis, and means for inhibiting said radar antenna from assuming less than a predetermined minimum threshold elevation notwithstanding a lesser elevation assumed by said optical axis.

16. A combination as in claim 15 further comprising a gunner operated controller and antenna-target misalignment signalling means, wherein said means for variably adjusting said optical axis determining means is connected and responsive to said controller, and to said misalignment signalling means when said antenna is above said predetermined threshold elevation, for controlling said optical axis determining means.

17. In combination, a rotatable mount; weapon means, an optical sight and a radar antenna all disposed on said mount and adapted to rotate therewith; first actuator means for shifting the optical axis of said optical sight relative to said rotatable mount; controller means for energizing said optical sight shifting actuator means; and second actuator means responsive to said optical axis positioning effected by said first actuator means for aligning said radar antenna with said optical axis.

18. A combination as in claim 17 further comprising third actuating means for rotating said mount.

19. A combination as in claim 18 further comprising data processing means for developing lead angle and mount rotation rate output signals, said third actuating means being responsive to said data processing means output signals and to said optical axis shifting first actuator means for selectively rotating said mount.

20. A combination as in claim 19 further comprising mount rotation monitoring means connected to said first actuating means in a sense opposite to the output of said controller means.

21. A combination as in claim 19 further comprising inertial monitoring means responsive to the motion produced by said first actuator means, said inertial monitoring means being connected to said first actuating means in a sense opposite to the output of said controller means.

22. A combination as in claim 17 further comprising platform motion monitoring means connected to said first actuating means.

* * * * *